US006341838B1

(12) United States Patent
Miyauchi

(10) Patent No.: US 6,341,838 B1
(45) Date of Patent: Jan. 29, 2002

(54) RECORDING APPARATUS

(75) Inventor: Yasuo Miyauchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/350,702

(22) Filed: Dec. 7, 1994

Related U.S. Application Data

(63) Continuation of application No. 07/904,037, filed on Jun. 25, 1992, now abandoned.

(30) Foreign Application Priority Data

Jun. 27, 1991 (JP) ..... 3-181687

(51) Int. Cl.[7] ..... B41J 23/00; B41J 2/01; B41J 29/13; B41J 29/54

(52) U.S. Cl. ..... 347/37; 347/104; 347/108; 400/663; 400/664

(58) Field of Search ..... 346/134, 140 R; 347/108, 104, 29, 37; 400/636.1, 663, 664, 667, 668

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,723,129 A | | 2/1988 | Endo et al. | |
| 4,740,796 A | | 4/1988 | Endo et al. | |
| 4,859,099 A | * | 8/1989 | Kanemoto et al. | 400/636.1 |
| 4,967,204 A | * | 10/1990 | Terasawa et al. | 347/29 X |
| 5,184,902 A | * | 2/1993 | Harada et al. | 400/185 |
| 5,579,039 A | * | 11/1996 | Kurata et al. | 347/49 |

FOREIGN PATENT DOCUMENTS

| | | | | |
|---|---|---|---|---|
| EP | 0143250 | * | 6/1985 | 347/49 |
| EP | 0379151 | | 7/1990 | |
| JP | 59056847 | * | 5/1979 | |
| JP | 60071260 | * | 4/1984 | |
| JP | 59123670 | * | 7/1984 | |
| JP | 59138461 | * | 8/1984 | |
| JP | 60172575 | | 9/1985 | |
| JP | 60172576 | | 9/1985 | |
| JP | 61279573 | | 10/1986 | |
| JP | 62174167 | | 7/1987 | |
| JP | 363009548 A | * | 1/1988 | B41J/3/04 |
| NL | 283792 | | 1/1965 | |

OTHER PUBLICATIONS

T.L. Wilmoth, "Carriage—Locking Mechanism", *IBM Technical Disclosure Bulletin,* pp. 5229–5230, vol. 22, No. 12, May 1980.*

* cited by examiner

*Primary Examiner*—David F. Yockey
(74) *Attorney, Agent, or Firm*—Fitzpatrick, Cella, Harper & Scinto

(57) ABSTRACT

A recording apparatus provided with a covering member which can be attached to or removed from a main assembly of the apparatus includes a conveying device for conveying recording material; a recording device for carrying out a recording operation while moving along a surface of the recording material; and a movement prevention device for regulating movement of the recording device, depending on an open or closed state of the covering member; wherein the movement prevention device confines the movement of the recording device when the covering member is open, and releases the recording device from the confining action of the movement prevention device when the covering member is closed. Further, a preventing mechanism prevents opening of an opening mechanism which opens a nip in the conveying mechanism when the recording device is out of a recording region.

21 Claims, 5 Drawing Sheets

RECORDING APPARATUS

This application is a continuation of application Ser. No. 07/904,037 filed Jun. 25, 1992, now abandoned.

FIELD OF THE INVENTION AND RELATED ART

The present invention relates to a recording apparatus usable to make a recording on recording medium, in particular to a recording apparatus in which the movement of the recording means is prevented when the covering member is opened.

In the past, in the case of a serial recording type of recording apparatus, a single line of recording was carried out through scanning by the carriage, and then, a conveying or feeding mechanism was driven to move the recording paper by a necessary pitch for the next line and thereafter the recording operation is effected for the next line.

This type of recording apparatus is configured in such a manner that its carriage is parked at a predetermined location, in other words, a so-called home position, after the printing is finished. The above mentioned home position is set up beyond the range of the conveying mechanism, so that the carriage does not interfere with the conveying mechanism when a jam (paper jam) occurs and the conveying system is opened up to take care of the jam.

However, it is liable in the case of the above mentioned prior example, that the carriage is moved from its location as a user inadvertently touches the carriage while taking care of the jam, whereby the interference between the carriage and the conveying mechanism results in apparatus damages when the conveying system is opened up.

Also, generally speaking, the head section of those using an ink jet printing type recording means is capped to prevent ink from drying when the recording head is parked at the above mentioned home position, but there is such problems that it becomes impossible to cap the head section when the carriage is inadvertently moved as is explained above, or that the ink solidifies to prevent the normal recording if the head is left uncapped.

SUMMARY OF THE INVENTION

Accordingly, it is a principal object of the present invention to provide a recording apparatus in which the recording means is prevented from moving when the covering member is opened while a paper jam and the like are taken care of, and in addition, the interference between the recording means and the conveying means is prevented when the conveying means is opened up.

According to an aspect of the prevent invention, there is provided a recording apparatus provided with: a covering member, which can be attached to or removed from the apparatus main assembly, a conveying means for conveying recording medium; a recording means for carrying out a recording operation while moving along the surface of said recording medium; and a movement prevention means for regulating the movement of said printing means, depending on the open or closed state of said covering member, wherein said movement prevention means regulates the movement of said recording means when said covering member is open, and releases said recording means from the regulation by said movement prevention means when said covering member is closed.

As for the other means, the above recording means further comprises a releasing means for releasing said conveying means, and a release prevention means; wherein said release prevention means allows said releasing means to be operable only when said recording means is at a predetermined location, and regulates the operation of said release means when said recording means is not at the predetermined location.

In the above mentioned means, since the movement prevention means regulates the movement of the recording means when the covering member is opened, the recording means can be prevented from being inadvertently moved while a paper jam and such are taken care of, and since the above mentioned movement prevention means is activated or deactivated depending on the open or closed state of the above mentioned covering member, the above mentioned recording means can be reliably prevented from moving.

Further, since the conveying means is prevented by the release prevention means from being opened up unless the recording means is at the predetermined location, the apparatus damages, which may be caused by carelessness while the above mentioned paper jam is taken care of, can be prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Figure 1:
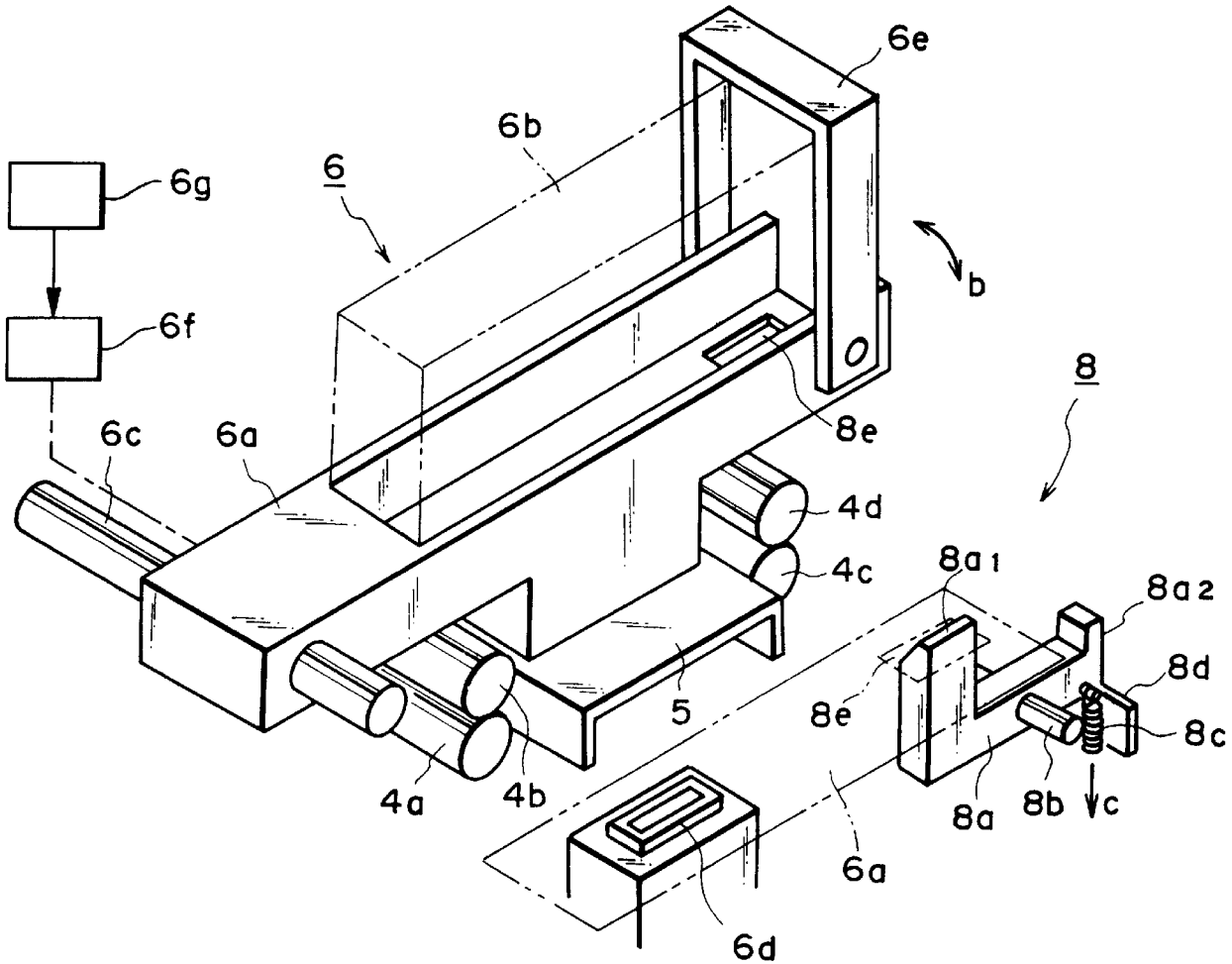
FIG. 1 is a schematic diagram showing the configuration of the movement prevention means of the recording means in accordance with a preferred embodiment of the present invention.
Figure 2:
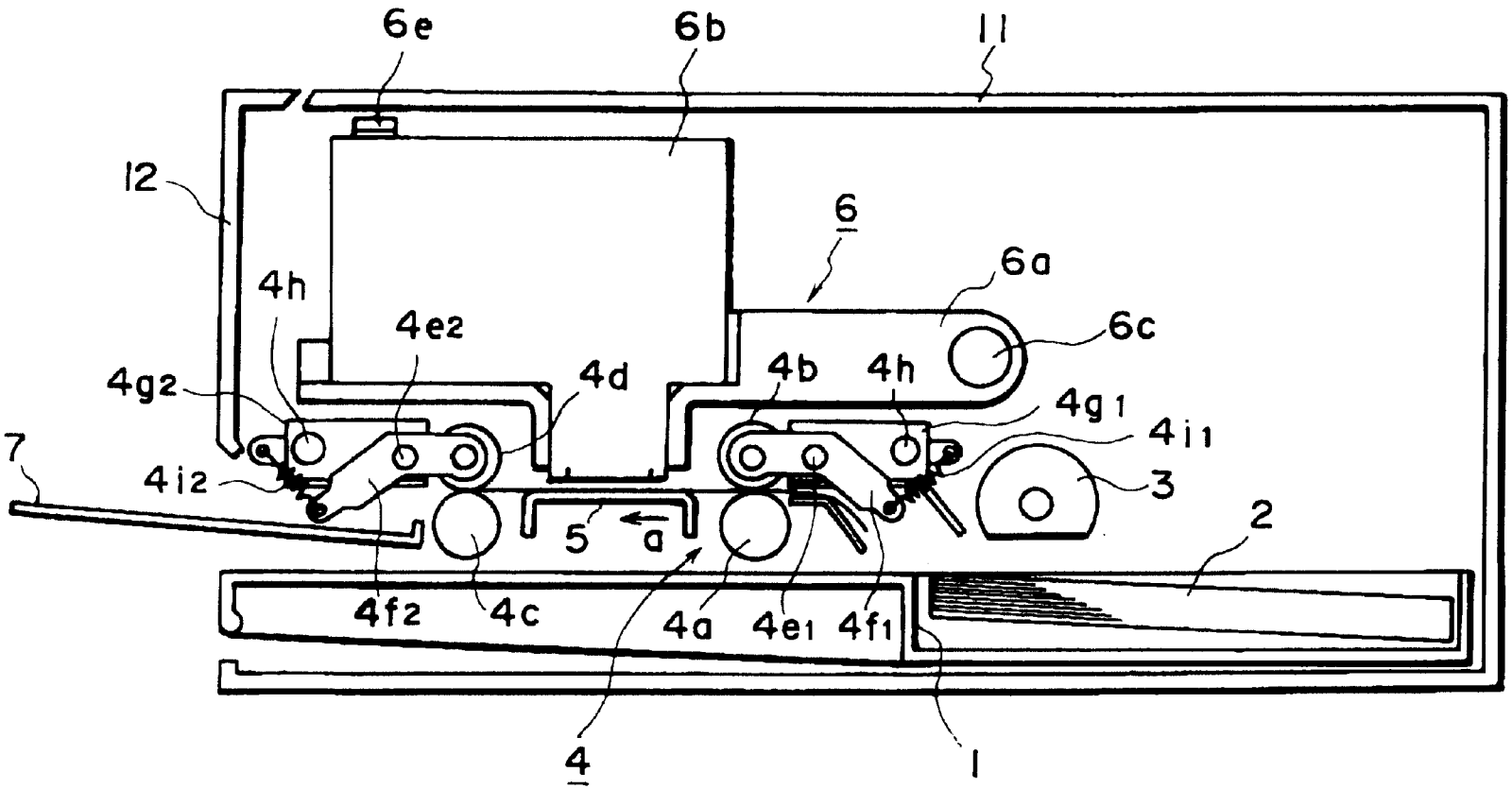
FIG. 2 is a schematic sectional diagram showing the longitudinal cross section of the entire recording apparatus.
Figure 3:
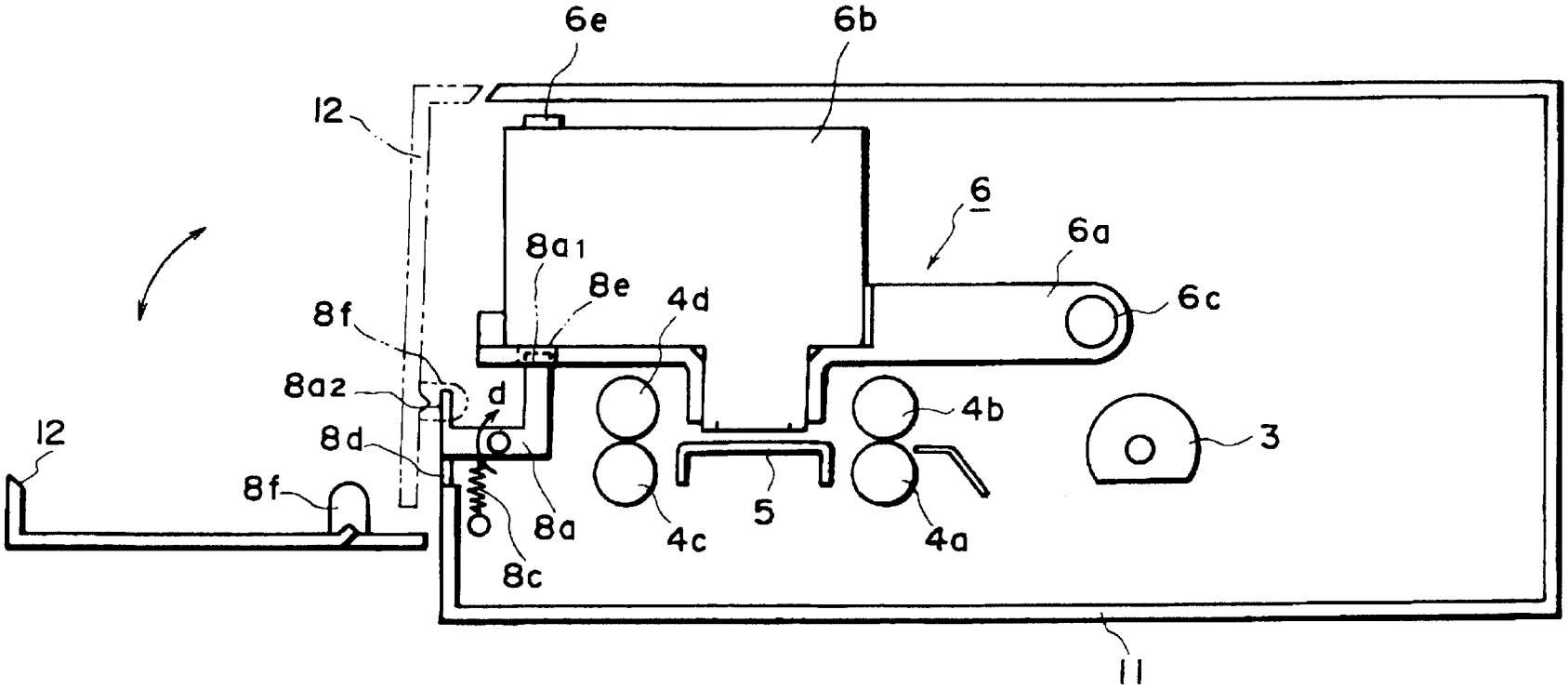
FIG. 3 is a schematic diagram showing the relation between the movement prevention means and the covering member.
Figure 4:
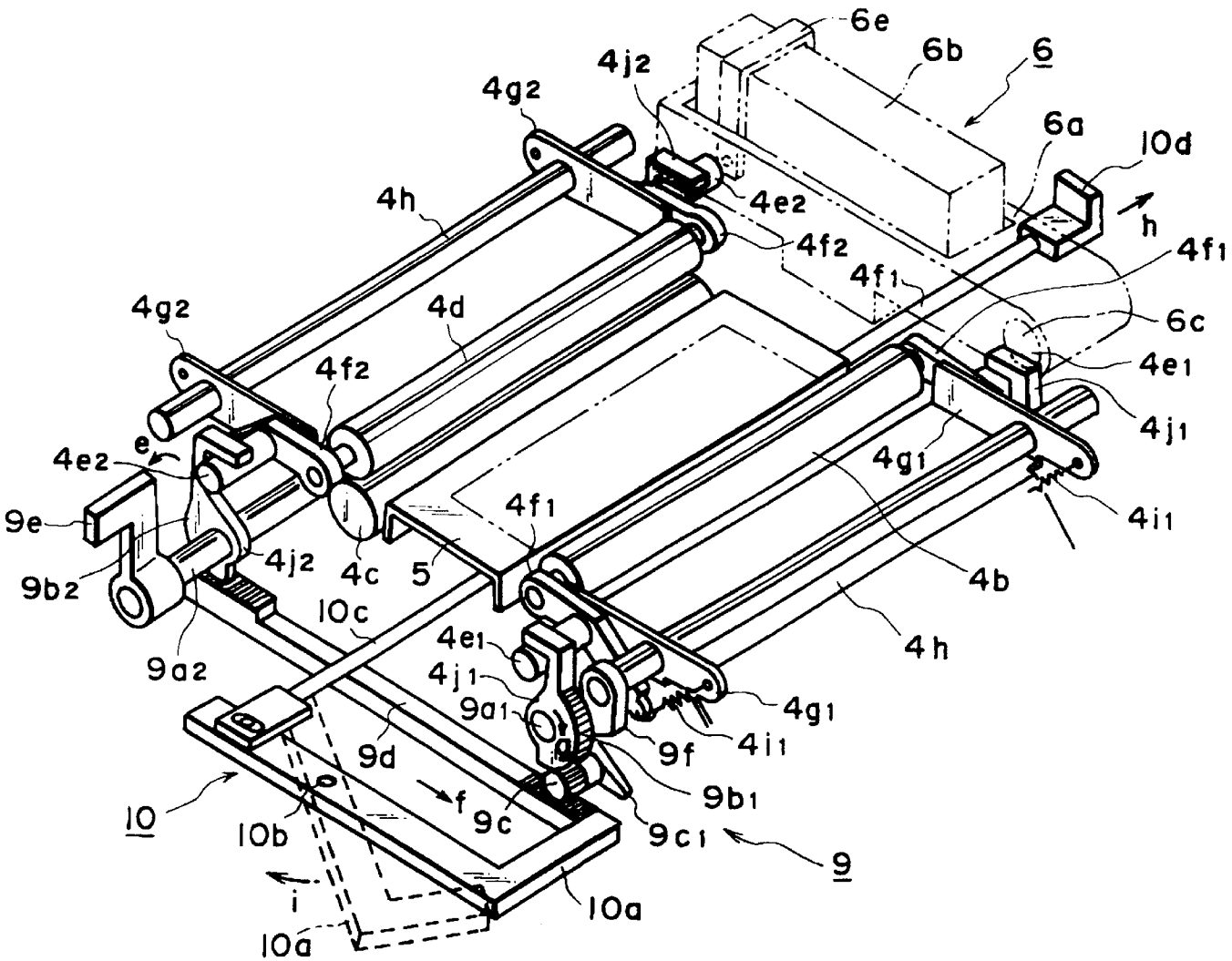
FIG. 4 is a schematic diagram showing the configurations of the conveying means and the release prevention means.
Figure 5:
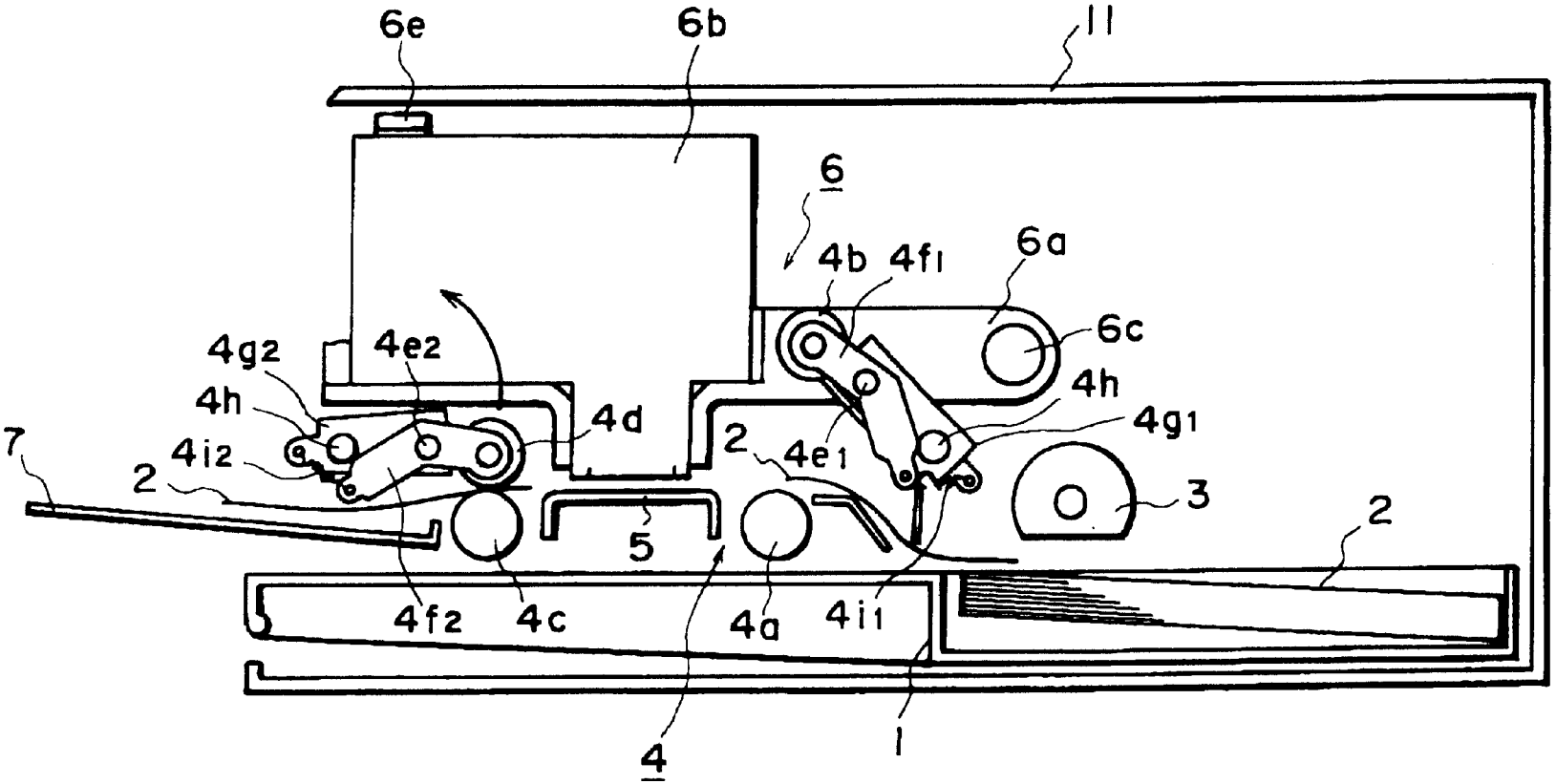
FIG. 5 is a schematic diagram showing the released state of the conveying means.

A recording apparatus in accordance with an embodiment of the present invention, in which the above mentioned means is applied to the ink jet recording system, is explained referring to FIG. 1 to FIG. 5. FIG. 1 is an explanatory view showing the configuration of the movement prevention means for regulating the movement of the recording means in FIG. 1. FIG. 2 is a schematic sectional view of the overall configuration of the recording apparatus. FIG. 3 is an explanatory view showing the configuration of the sheet conveying means, FIG. 4 is an explanatory view showing the sheet conveying means, and FIG. 5 is an explanatory view of the sheet conveying means in the open state.

This recording apparatus is configured as is shown in FIG. 2, wherein recording sheets 2 stacked in a cassette 1 are fed piece by piece by a pickup roller 3 and conveyed by sheet conveying means 4; recording means 6 is driven to make a recording on recording sheet 2 supported from behind by platen 5; and after the recording, the recording sheet 2 is discharged into discharge tray 7.

In this structure, the movement of the above mentioned recording head 6 is regulated by a movement prevention means 8 in FIG. 1 when the recording head 6 is at the home position. Further, a releasing means 9 in FIG. 4 allows the above mentioned conveying means 4 to be opened up in order to take care of the paper jam and such, but release prevention means 10 allows the opening only when the recording means 6 is at the home position.

Next, a practical explanation is given to the structure of each of the above mentioned means.

Sheet Conveying Means

Sheet conveying means 4 comprises, as is shown in FIG. 2 and FIG. 4, a conveying roller 4*a* and a pinch roller 4*b* for conveying the recording sheet 2 to the recording region, and a discharge roller 4*c* and a pinch roller 4*d* for discharging the recorded recording sheet 2 into a discharge tray 7. The above mentioned pinch rollers 4*b* and 4*d* are rotatably attached to arms 4*f*1 and 4*f*2 which are axially supported by pressure generating shafts 4*e*1 and 4*e*2. On the above mentioned pressure generating shafts 4*e*1 and 4*e*2, upper guides 4*g*1 and 4*g*2 are affixed, which guide the upper surface of the recording sheet 2, and these guides 4*g*1 and 4*g*2 are axially supported by shaft 4*h*. Between the above mentioned upper guides 4*g*1 and 4*g*2 and arms 4*f*1 and 4*f*2, tension springs 4*i*1 and 4*i*2 are stretched.

Further, rotatable hooks 4*j*1 and 4*j*2 are provided, and as these hooks 4*j*1 and 4*j*2 become engaged with the above mentioned pressure generating shafts 4*e*1 and 4*e*2, pinch rollers 4*b* and 4*d* come in contact with the conveying roller 4*a* and the discharge roller 4*c*, respectively, generating pressure at their points of contact.

The above mentioned conveying roller 4*a* and discharge roller 4*c* are rotated by an unshown conveyer motor connected to them, and the recording sheet 2 is conveyed in the direction of an arrow mark (a) in FIG. 2 by the coordinated operation between these rollers and the pinch rollers 4*b* and 4*d* which are also induced to rotate by the rotation of the former.

Moreover, the driving force is transmitted in such a manner that the peripheral velocity of the above mentioned discharge roller 4*c* is several percentage points higher than that of the conveying roller 4*a*, to give a proper tension to the recording sheet 2 while being conveyed.

The recording means 6 records an ink image on the recording sheet 2 conveyed by the conveying means 4. In this apparatus, a serial type ink jet recording system is adopted, in which an ink jet head 6*b* is mounted on a carriage 6*a*.

The carriage 6*a* is slidably attached to a slide rail 6*c* shown in FIG. 1, and is made to reciprocate in the width direction of the recording paper 2, following the slide rail 6*c*, by a carriage motor and a driving force transmission mechanism schematically designated as 6*g* and 6*f*, respectively.

At the home position of this carriage 6*a*, a capping means 6*d* is provided as is shown in FIG. 1, so that, when the recording head 6*b* is parked at the home position, this capping means 6*d* covers the ink ejecting surface of the recording head 6*b*, preventing the ink from drying and also protecting the head.

Moreover, the home position of the carriage 6*a* is set up beyond the region to where the recording sheet 2 is conveyed.

The recording head 6*b* ejects the ink onto the recording sheet 2 conveyed by the conveying means 4; the recording head 6*b* is mounted on the above mentioned carriage 6*a*, and ejects the ink, selectively and synchronously with the movement of the carriage 6*a*, to record the ink image on the recording sheet 2, corresponding to recording signals.

This recording head 6*b* is provided with fine openings (orifices) to eject liquid, a liquid passage, an energy application section provided at a given location of this liquid passage, and an energy generating means for generating the droplet forming energy to be applied to the liquid in this energy application section. As the recording system using an energy generating means for generating such energy, there are a recording system using an energy generating means in which an electromechanical transducer such as a piezoelectric element is used; a recording system using a method using an energy generating means in which an electromagnetic wave, such as a laser, is irradiated to generate heat, which is applied to eject droplets; a recording system using a method using an energy generating means in which an electrothermal transducer, such as a heating element containing a heating resistor, heats the liquid to eject the liquid; and the like. Among them, the recording head used in the ink jet recording system, in which the liquid is ejected by thermal energy, can produce a high resolution image since the liquid ejection opening (orifice) for ejecting the recording liquid can be packaged in high density. Among them, the recording head using the electrothermal transducer as the energy generating means can take full advantage of the recent technological development in the field of semiconductors, and the improved reliability in the fields of IC technology and micro-processing technology, whereby its size can be easily reduced; high density packaging can be simplified; and also, the manufacturing costs become low.

Moreover, the above mentioned recording head 6*b* can be unitized with an ink tank and detachably mounted on carriage 6*a*, and can be replaced as needed. Therefore, a U-shaped latching lever 6*e* is attached to carriage 6*a* as is shown in FIG. 1, so that it can rotate in the direction of arrow b. In other words, when the recording head 6*b* is mounted on carriage 6*a*, the latching lever 6*e* is rotated to the position as shown in FIG. 1 to latch the recording head 6*b* down to the carriage 6*a*, and when it is removed, the latching lever 6*e* is pushed down in the arrow (b) direction in FIG. 1 to release it.

It is liable that the carriage 6*a* may be moved away from its home position, depending on the way the force is applied to rotate the above mentioned latching lever 6*e*. Therefore, in this preferred embodiment, the movement prevention means 8 is provided to prevent the recording head 6*b* from being moved when it is replaced.

Movement Prevention Means

Next, the structure of the movement prevention means 8 is explained. In this structure, a U-shaped movement prevention means 8*a* is provided at the home position of the carriage 6*a*, in such a manner that it can rotate around shaft 8*b*. This movement prevention member 8*a* is urged in the arrow (c) direction in FIG. 1 by a tension spring 8*c*, whereby its lower end remains in contact with a stopper 8*d*. Also, a tapered section 8*a*1 is formed at one end of the above mentioned movement prevention member 8*a*, and at the predetermined location of the bottom surface of carriage 6*a*, there is an engagement hole 8*e* drilled to be engaged with the tapered section 8*a*1.

Further, in this structure, the operation of the above mentioned movement prevention member 8*a* is interlocked with the opening or closing of the covering member 12. In other words, according to the structure of this recording apparatus, covering member 12 can be attached to or removed from the apparatus main assembly 11 as is shown in FIG. 3, and projection 8*f* is provided on the inner surface of the covering member 12. This projection 8*f* presses the end section 8*a*2 of the movement prevention member 8*a* when the covering member 12 is closed, and the above mentioned pressure is released when the covering member 12 is opened or removed.

Therefore, when the covering member 12 is in the closed state as is outlined by the two-dot chain line in FIG. 3, the projection 8*f* presses the above mentioned end section 8*a*2, rotating thereby the movement prevention member 8*a* around the shaft 8*b* in the arrow (d) direction by this pressure, and as a result, the tapered section 8*a*1 and engagement hole 8*e* remains disengaged, enabling thereby the carriage 6*a* to slide along the slide rail 6*c* to carry out the recording operation without interference.

On the other hand, when the covering member 12 is removed for an operation such as replacing the recording head, the above mentioned projection 8*f* ceases to press the end section 8*a*2 of the movement prevention member 8*a*, allowing thereby the movement prevention member 8*a* to rotate to come in contact with the stopper 8*d* due to the tension of the spring 8*c*. At this time, if the carriage 6*a* is at its home position (position outlined by the two-dot chain line), the tip of the tapered section 8*a*1 becomes engaged, as is outlined by the solid line in FIG. 3, to the engagement hole 8*e* drilled in the carriage 6*a*, and remains engaged there. Therefore, the movement of the carriage 6*a* along the slide rail 6*c* is regulated, whereby an occurrence is prevented such that the carriage 6*a* is inadvertently moved during the head replacing operation and the like.

Further, if the carriage 6*a* is moved toward its home position when the covering member 12 is in the open state due to an unexpected accident such as a power failure and the carriage 6*a* remains suspended at a location other than its home position, the under side of the carriage 6*a* slides along the surface of tapered section 8*a*1, whereby the movement prevention ember 8*a* is pressed down, and as it is further moved, the tapered section 8*a*1 engages into the engagement hole 8*e* due to the urging force of spring 8*c*, thereby regulating the movement of the carriage 6*a* from the home position.

As has been described above, when the covering member 12 of this recording apparatus is opened, the movement prevention member 8*a* coordinately responds to regulate the movement of the carriage 6*a* at the home position, and when the covering member 12 is closed, it releases the carriage 6*a* from the movement regulation. Therefore, inadvertent movement of the carriage 6*a* when the recording head 6*b* is replaced or the paper jam and such are taken care of is eliminated.

Releasing Means

Next, the releasing means 9 is a mechanism for making it easier to take care of the paper jam when the recording sheet 2 is jammed by the sheet conveying means 4, or a like incident occurs, and it allows the pinch roller 4*b* to be released away from the conveying roller 4*a*, and the pinch roller 4*d* from the discharge roller 4*c*, so that there are sufficient gaps between the respective rollers.

Its structure is as shown in FIG. 4, that is, hooks 4*j*1 and 4*j*2 are solidly affixed to shafts 9*a*1 and 9*a*2, and the hooks 4*j*1 and 4*j*2 are integrally formed with gear sections 9*b*1 and 9*b*2 which rotate around the above mentioned shafts 9*a*1 and 9*a*2. One of the above mentioned gear sections, the gear section 9*b*1, is indirectly meshed with the rack member 9*d* through the cam gear 9*c*, and the other, the gear section 9*b*2, is directly meshed with rack member 9*d*.

An operating lever 9*e* is attached to the above mentioned shaft 9*a*2. Therefore, when the operating lever 9*e* is rotated in the arrow (e) direction in FIG. 4, the hook 4*j*2 rotates in the arrow (e) direction, becoming disengaged from the pressure generating shaft 4*e*2; simultaneously, the rack member 9*d* slides in the arrow (f) direction; the hook 4*j*1 rotates in the arrow (g) direction, getting disengaged from the pressure generating shaft 4*e*1; and as a result, the pressure between the conveying roller 4*a* and pinch roller 4*b*, and the discharge roller 4*c* and the pinch roller 4*d*, are released. At this time, release prevention member 10*a*, which is explained later, is poised as outlined by the broken line in FIG. 4.

At this time, arms 4*f*1 and 4*f*2 are held by the tension from springs 4*i*1 and 4*i*2 while the sections of these arms 4*f*1 and 4*f*2 remain in contact with shaft 4*h*. As the operating lever 9*e* is further rotated in the arrow (e) direction, the arm 9*c*1 affixed to the cam gear 9*c* rotates a cam 9*f* affixed solidly to shaft 4*h*, and as a result, the pinch roller 4*b* is lifted upward together with the upper guide 4*g*1, as is shown in FIG. 5.

Therefore, the sheet conveying means 4 is widely opened up, whereby the recording sheet 2 jammed in the conveying passage can be easily removed.

Release Prevention Means

In such a situation as is shown in FIG. 5 in which the sheet conveying means 4 is wide open as was described above, the upper guide 4*g*1 and the pinch roller 4*b* are invading into the scanning range of the carriage 6. Reversely speaking, this means that if the operating lever 9*e* is operated when the carriage 6*a* remains suspended at a location other than its home position, the upper guide 4*g*1 and the pinch roller 4*b* interfere with the carriage 6*a*. Therefore, in this preferred embodiment, the release prevention means 10 is provided, so that the sheet conveying means 4 is allowed to be opened up only when the carriage 6*a* is at the home position, and if the carriage 6*a* is at any other location, the conveying means 4 is prevented from being opened up.

As for the configuration of the release prevention means 10, an L-shaped release prevention member 10*a* is provided, which can pivot about shaft 10*b*. When this release prevention member 10*a* takes the position outlined by the solid line in FIG. 5, the end section of the rack member 9*d* remains in contact with the release-prevention member 10*a*. Also, one end of connecting rod 10*c* is pivotally attached to the above mentioned release prevention member, and on the other end of this connecting rod 10*c*, an L-shaped engaging member 10*d* is mounted. This engaging member 10*d* engages with the lower end of the carriage 6*a* and slides the connecting rod 10*c* in the arrow (h) direction as the carriage 6*a* is moved toward its home position.

Therefore, when the carriage 6*a* is at a location other than the home position, the release prevention member 10*a* takes the position outlined by the solid line, preventing the rack member 9*d* from sliding in the arrow (f) direction. As a result, the operating lever 9*e* cannot be operated in the arrow (e) direction, preventing the sheet conveying means 4 from being opened up.

On the other hand, when the sheet conveying means 4 is opened up to take care of a paper jam or the like, the movement of carriage 6*a* toward its home position makes the connecting rod 10*c* slide in the arrow (h) direction; the release prevention means 10*a* rotates to take the position outlined by the broken line in FIG. 4, allowing the rack member 9*d* to slide; and therefore, the operating lever 9*e* can be operated to open up the sheet conveying means 4. At this moment, the movement of the carriage 6*a* is prevented by the movement prevention means 8.

As was described above, in this preferred embodiment, the sheet conveying means 4 can be opened up only when the carriage 6*a* is at its home position, and when the carriage 6*a* is at any other location, the sheet conveying means 4 is prevented by the release prevention means 10 from being opened up, and therefore, damages to carriage 6*a*, the recording head 6*b*, and the like, can be prevented.

Other Embodiments

In the preferred embodiment described above, the ink jet recording method is used as the recording means, but a more specific preferred configuration is such that electric current is flowed through the electrothermal transducer corresponding to the recording signal, and the bubble grown by film boiling caused by the heat from the above mentioned electrothermal transducer is used to eject the ink for recording.

Preferably, the recording head and the apparatus is of the type disclosed in U.S. Pat. Nos. 4,723,129 and 4,740,796 which disclose a typical structure and operational principle. The structure and principle are applicable to a so-called continuous type recording system. Particularly, however, the bubble jet structure and principle are suitable for the on-demand type because the principle is, in brief, such that at least one driving signal is applied to an electrothermal transducer disposed on a liquid retaining sheet or passage, the driving signal being enough to provide such a quick temperature rise beyond a departure from nucleate boiling point, by which the thermal energy is provided to produce the film boiling at the heating portion of the recording head, upon which a bubble can be formed in response to the driving signal. By the development and contraction of the bubble, the liquid is ejected through an ejection outlet to produce at least one droplet. The driving signal is preferably in the form of a pulse, because the development and contraction of the bubble can occur instantaneously, and therefore, the liquid is ejected with quick response.

The driving signal in the form of a pulse is preferably such as disclosed in U.S. Pat. Nos. 4,463,359 and 4,345,262. In addition, the temperature increasing rate of the heating surface is preferably as disclosed in U.S. Pat. No. 4,313,124.

The structure of the recording head may comprise the combination of the ejection outlet, the liquid passage and the electrothermal transducer as disclosed in the above mentioned U.S. Patent (linear liquid passage or rectangular liquid passage), or may be those disclosed in U.S. Pat. Nos. 4,558,333 and 4,459,600 wherein the heating portion is disposed at a bent portion. The present invention is also applicable to the structure disclosed in Japanese Laid-Open Patent Application No. 123670/1984 wherein a common slit is used as the ejection outlets for plural electrothermal transducers, and also to the structure disclosed in Japanese Laid-Open Patent Application No. 138461/1984 wherein an opening for absorbing pressure waves of the thermal energy is formed corresponding to the ejection portion. In other words, according to the preferred embodiment of the present invention, the printing process can be carried out, surely and efficiently, whatever form the recording head takes.

Further, the present invention is effectively applicable to a recording head in the form of an exchangeable chip which is electrically connected with and supplied with ink from the main assembly of the recording apparatus when mounted on the main assembly, or in the form of a cartridge type recording head integrally mounted.

The provision of the recovery means or the auxiliary means for the preliminary operation is preferable, because it can further stabilize the advantageous effects of the present invention. As for examples of such means, there are capping means for capping the recording head, cleaning means for cleaning the recording head, pressure applying means or sucking means for applying pressure to or sucking the liquid in the passage, preliminary heating means using the ejecting electrothermal transducers or by a combination of the ejecting thermal transducer and additional heating means, and means for effecting preliminary ejection of the liquid not for the recording operation. They can stabilize the recording operation.

As regards the recording mode of the recording apparatus, it is not limited to record only by a main color such as black. The present invention is effectively applicable to a recording apparatus having an integral recording head or a combination of plural recording heads for the recording operation at least one of the multi-color modes using different colors and a full-color mode using color mixture.

Additionally, in the foregoing embodiment, the ink has been described as liquid. However, it may be an ink material which is solid at the room temperature or an ink material which is softened at the room temperature. Since in the ink jet recording system, the ink is usually controlled within the temperature not lower than 30° C. and not higher than 70° C. to stabilize the viscosity of the ink to stabilize the ejection, the ink may be such that it is liquid when the recording signal is applied in use. The present invention is applicable to the ink which is liquefied by application of the thermal energy thereto. In an example of such a type, the thermal energy is positively consumed for the phase change from the solid state to the liquid state so as to suppress the temperature rise by the thermal energy. In another example, the ink is solidified when left as it is, for the purpose of preventing the evaporation. In these examples, the ink is liquefied by the application of the thermal energy thereto in response to the recording signal, and the liquefied ink is ejected. In one example, the ink already starts to be solidified when reaching the recording medium. Such an ink material may be retained as liquid or solid ink in holes or recesses formed in a porous sheet as disclosed in Japanese Laid-Open Patent Application Nos. 56847/1989 and 71260/1985, in this case, the sheet is faced to the electrothermal transducers. The most effective actuation of the above mentioned ink is to cause film boiling thereof.

Further, as for the form of the above mentioned ink jet type recording apparatus, the present invention is applicable to the printing apparatus which takes the form of a copying machine combined with a reader and the like, and a facsimile machine having transmission/reception function, besides those used as an image output terminal of the information processing machine such as computer.

Incidentally, as the recording means, an example using the ink jet type recording system was explained above, but the present invention does not need to be limited to the ink jet type recording system, and is also applicable to other recording systems such as thermal transfer recording system and thermal recording system, except the impact recording system such as wire dot recording system.

In the present invention, since the movement prevention means is provided, as was explained above, to regulate the movement of the recording means, depending on the open or closed state of the covering member, it is possible to prevent the recording means from being inadvertently moved when the covering member is opened to take care of the paper jam and the like.

Also, if the release means is provided for releasing the sheet conveying means from the recording medium, and also, the release prevention means is provided for locking the above mentioned release means when the recording means is not at the predetermined location, it becomes possible to prevent more reliably the interference between the recording means and the conveying means, whereby apparatus damage and the like can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus usable with an ink jet recording head for ejecting ink through an ejection outlet provided at an ink ejecting surface, comprising:

a casing;

a carriage carrying the ink jet recording head and moving the recording head in a predetermined direction;

means for moving said carriage in the predetermined direction between a recording region and a home position outside of the recording region;

a cover member for covering said casing, said cover member being openable when said carriage is at the home position and positions other than the home position;

movement preventing means, provided on said casing, for direct engagement with said carriage in response to an opening action of said cover member, wherein when said carriage is at the home position, said movement preventing means engages said carriage directly, and when said carriage is not at the home position, said movement preventing means does not engage said carriage;

a releasing member, provided on said cover member, and releasing engagement between said movement preventing means and said carriage in accordance with closing of said cover member.

2. An apparatus according to claim 1, further comprising opening means for opening a feeding passage for the recording medium, and preventing means for preventing opening of the feeding passage by said opening means, wherein when said carriage is at the home position, said preventing means permits opening of the feeding passage by said opening means, and when said carriage is not at the home position, said preventing means prevents said opening means from effecting opening of the feeding passage.

3. An apparatus according to claim 1, further comprising said ink jet recording head for ejecting ink through the ink ejection outlet.

4. An apparatus according to claim 3, wherein said ink jet recording head is provided with an electrothermal transducer element, and ejects the ink using heat that is generated by the electrothermal transducer element and applied to the ink.

5. An apparatus according to claim 1, wherein said cover member opens a movable range of said carriage.

6. A recording apparatus comprising:

a casing;

a carriage carrying a recording head member and moving the recording head member in a predetermined direction;

means for moving said carriage in the predetermined direction between a recording region and a predetermined position outside of the recording region;

a covering member openably covering said casing;

feeding means disposed adjacent a movement range of said carriage and having nip forming means for nipping and feeding a recording medium;

a limiting member limiting movement of said carriage by engagement with said carriage in accordance with opening of said covering member, when said carriage is at the predetermined position outside the recording region;

an opening mechanism opening the nip of said nip forming means; and a preventing mechanism preventing opening of said opening mechanism when said carriage is in the recording region, said preventing mechanism permitting opening of the nip only when said carriage is out of the recording region.

7. An apparatus according to claim 6, wherein the predetermined position is a home position of said carriage.

8. An apparatus according to claim 6, wherein said opening mechanism opens the nip at a location adjacent said carriage.

9. An apparatus according to claim 6, wherein said recording head member is provided with an ink ejection head for ejecting ink through an ink ejection outlet.

10. An apparatus according to claim 9, further comprising a cap for the ink election outlet, wherein the ink ejection outlet is capped with said cap at the predetermined position.

11. An apparatus according to claim 10, wherein said ink ejection head is provided with an electrothermal element, and ejects the ink using heat that is generated by the electrothermal transducer element and applied to the ink.

12. An ink jet recording apparatus comprising:

a casing;

a carriage carrying an ink jet recording head member and moving the ink jet recording head member in a predetermined direction;

means for moving said carriage in the predetermined direction between a recording region and a predetermined position outside of the recording region;

a covering member openably covering said casing;

feeding means disposed adjacent a movement range of said carriage and having nip forming means for nipping and feeding a recording medium;

a limiting member limiting movement of said carriage by engagement with said carriage in accordance with opening of said covering member, when said carriage is at the predetermined position outside the recording region;

an opening mechanism opening the nip of said nip forming means; and a preventing mechanism preventing opening of said opening mechanism when said carriage is in the recording region, said preventing mechanism permitting opening of the nip only when said carriage is out of the recording region.

13. An apparatus according to claim 12, wherein the predetermined position is a home position of said carriage.

14. An apparatus according to claim 12, wherein said opening mechanism opens the nip at a location adjacent said carriage.

15. An apparatus according to claim 12, wherein the ink jet recording head member includes an ink ejection head having an ink ejection outlet and the ink ejection outlet is capped at the predetermined position.

16. An apparatus according to claim 15, wherein said ink ejection head is provided with an electrothermal transducer element, and ejects the ink using heat that is generated by the electrothermal transducer element and applied to the ink.

17. A recording apparatus comprising:

a casing;

a carriage carrying a recording head member and moving the recording head member in a predetermined direction;

means for moving said carriage with in the predetermined direction between a recording region and a predetermined position outside of the recording region;

a covering member openably covering said casing;

feeding means disposed adjacent a movement range of said carriage and having nip forming means for nipping and feeding a recording medium;

a limiting member limiting movement of said carriage by engagement with said carriage in accordance with opening of said covering member, only when said carriage is at the predetermined position outside the recording region;

an opening mechanism opening the nip of said nip forming means;

a releasing member, provided on said covering member, for releasing engagement between said limiting member and said carriage in accordance with closing of said covering member; and a preventing mechanism preventing opening of said opening mechanism when said carriage is in the recording region, said preventing mechanism permitting opening of the nip only when said carriage is out of the recording region.

18. An apparatus according to claim 17, wherein the predetermined position is a home position of said carriage.

19. An apparatus according to claim 17, wherein said recording head member is provided with an ink ejection head for ejecting ink through an ink ejection outlet.

20. An apparatus according to claim 19, wherein the ink ejection outlet is capped at the predetermined position.

21. An apparatus according to claim 20, wherein said ink ejection head is provided with an electrothermal transducer element, and ejects the ink using heat that is generated by the electrothermal transducer element and applied to the ink.

* * * * *

UNITED STATES PATENT AND TRADEMARK OFFICE

CERTIFICATE OF CORRECTION

PATENT NO. : 6,341,838 B1
DATED : January 29, 2002
INVENTOR(S) : Miyauchi

It is certified that error appears in the above-identified patent and that said Letters Patent is hereby corrected as shown below:

Title page,
Item [56], References Cited, FOREIGN PATENT DOCUMENTS,
-- EP 0422483 4/1991 -- should be inserted.
"59056847" should read -- 54-56847 --.
"60071260 4/1984" should read -- 60-71260 4/1985 --.
"59123670" should read -- 59-123670 --.
"59138461" should read -- 59-138461 --.
"60172575" should read -- 60-172575 --.
"60172576" should read -- 60-172576 --.
"61279573" should read -- 61-279573 --.
"62174167" should read -- 62-174167 --.
"363009548" should read -- 63-9548 --.

Column 1,
Line 37, "is" should read -- are --.
Line 55, "assembly," should read -- assembly; --.

Column 4,
Line 9, "electromechanical" should read -- electro-mechanical --.

Column 5,
Line 34, "ember" should read -- member --.

Column 6,
Line 38, "FIG. 5," should read -- FIG. 4, --.

Column 7,
Line 47, "outlets" should read -- outlet --.

Column 8,
Line 47, "as" should read -- as a --.

UNITED STATES PATENT AND TRADEMARK OFFICE

CERTIFICATE OF CORRECTION

PATENT NO. : 6,341,838 B1
DATED : January 29, 2002
INVENTOR(S) : Miyauchi

It is certified that error appears in the above-identified patent and that said Letters Patent is hereby corrected as shown below:

Column 9,
Line 30, “carriage;” should read -- carriage; and --.

Column 11,
Line 1, “with” should be deleted.

Signed and Sealed this

Seventeenth Day of September, 2002

*Attest:*

*Attesting Officer*

JAMES E. ROGAN
*Director of the United States Patent and Trademark Office*